United States Patent [19]

Reinertz

[11] Patent Number: 4,631,822

[45] Date of Patent: Dec. 30, 1986

[54] PROCESS FOR PRODUCING CABLES FITTED WITH ELECTRICAL CONNECTORS

[75] Inventor: Rudolf Reinertz, Wuppertal, Fed. Rep. of Germany

[73] Assignee: Grote & Hartmann GmbH & Co. KG, Fed. Rep. of Germany

[21] Appl. No.: 630,808

[22] Filed: Jul. 13, 1984

[30] Foreign Application Priority Data

Jul. 16, 1983 [DE] Fed. Rep. of Germany ..... 3325719

[51] Int. Cl.[4] ..... H01R 43/04

[52] U.S. Cl. ..... 29/861; 29/564.4; 29/564.6; 29/863; 81/9.51

[58] Field of Search ..... 81/9.51; 29/753, 867, 29/863, 564.4, 564.6

[56] References Cited

U.S. PATENT DOCUMENTS

| | | | |
|---|---|---|---|
| 3,653,412 | 4/1972 | Gudmestad | 81/9.51 X |
| 3,872,584 | 3/1975 | Chick et al. | 81/9.51 X |
| 4,145,807 | 3/1979 | Beetz et al. . | |
| 4,164,808 | 8/1979 | Gudmestad et al. | 81/9.51 X |
| 4,166,315 | 9/1979 | Gudmestad et al. | 29/753 X |

FOREIGN PATENT DOCUMENTS 1587342 4/1981 United Kingdom .

*Primary Examiner*—Howard N. Goldberg
*Assistant Examiner*—Carl J. Arbes
*Attorney, Agent, or Firm*—Goodman & Teitelbaum

[57] ABSTRACT

The invention relates to a process for the production of cables fitted with electrical connectors, in which several cables are drawn off, preferably simultaneously, from different cable storers, thereupon the cables are cut to length, at least one cable end being stripped and fitted with a connector, in which system from a cable storer in each case several cable strands of at least two different cable types are drawn off, the cable strands of each cable type being conducted into a separate transport plane or into a separate transport path of one plane, at which time the cable strands of like or unlike type are selected and conducted into a drawn-off plane, from which they are gripped and conveyed onward for cutting to length. The invention relates, further, to a device for the execution of the process including a cable storer (1) that stores different cable types, and with a cable feed changer (9) which is arranged after the cable storer (1) in transport direction of the cable strands, the cable feed changer (9) being fitted with guide elements which guide the cable strands preprogrammably into the drawn-off plane at predetermined locations at the outlet (10) of the cable feed changer (9).

10 Claims, 1 Drawing Figure

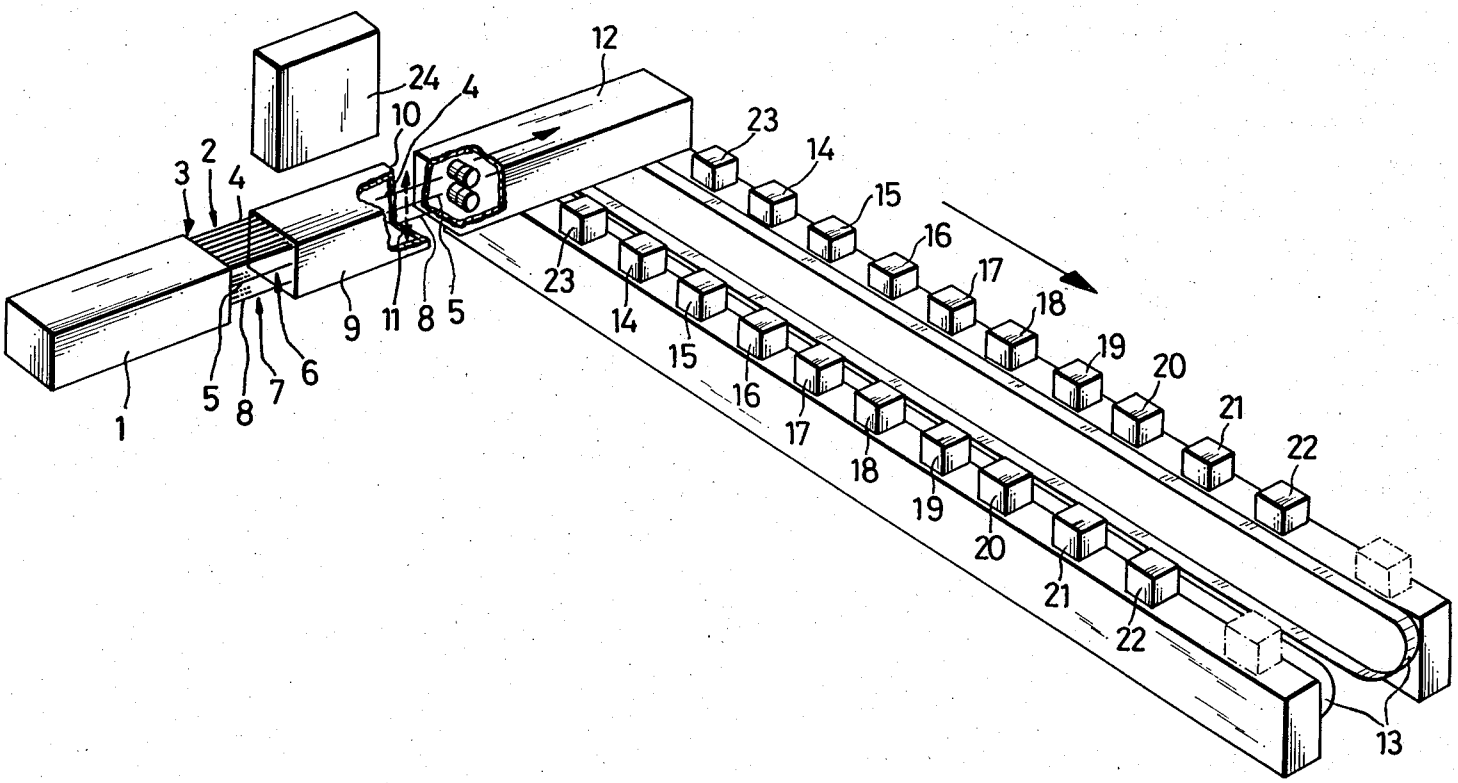
1
2
3
4
5
6
7
8
9
10
11
12
13
14
15
16
17
18
19
20
21
22
23
24

PROCESS FOR PRODUCING CABLES FITTED WITH ELECTRICAL CONNECTORS

The invention relates to a process and to a device for producing cables fitted with electrical connectors, in which several, for example eight cables, are drawn off, preferably simultaneously, from different cable storers, thereupon the cables are cut to length, at least one cable end being stripped and fitted with a connector.

A process and a device of this type are described in German unexamined patent specification No. OS 27 02 188, as published in corresponding British patent specification No. 1,587,342. As disclosed in these specifications, each cable is drawn off from a storer, conducted in a horizontal plane, gripped on its front free end and cut to length, in which system the cable is first conveyed forward a constant distance in the axial direction of the cable. Then, a preselected length, possibly with loop a formation with the front end fixed in space, is gripped in front of the predetermined rear end, severed and during the cutting to length, given over to a transport arrangement. With the cable being gripped in front and in back, the cable is horizontally further transported at a right angle to the axial direction of the cable ends, at least one end region being stripped and fitted with a connector. The cables, after being cut to length, are to be conveyed onward en bloc. This known process and the known device for the execution of the process operate very rapidly and have proved highly successful. It is only possible, however, to work with cables of the same cross section, because the sequence devices cannot be set for different kinds of cable without reoutfitting the devices for each cross section.

The object of the invention is to provide a process and an apparatus which operate still more rapidly than the prior art, and which can work several differnt types of cable without requiring the reoutfitting of the device.

This object is achieved by the invention, as set forth below.

With the aid of the schematic drawing the invention is explained in detail by way of example.

A device according to the invention for the production of cables fitted with electrical connectors presents a cable storer 1, in which, for example, thirty cable drums (not represented) are accommodated. Cable transport and guide elements (not represented) make possible the transport of, in each case, ten cable strands 4 in a horizontal plane 2 at the outlet 3 of the cable storer 1. These cable strands 4 consist of cables of the same or of different kind in respect to cross section, color, insulation, etc. Into a plane 6, underneath the plane 2, there are guided ten cable strands 5, for example of another type or several other cable types, and again underneath the plane 6, there is present a cable strand plane 7 with ten cable strands 8 of still another cable type or types. Obviously, the number of cable strands 4, 5 and 8 in the plane 2, 6 and 7 is arbitrary, and also the number of planes can be arbitrary. It is essential, however, to have available at least one further plane in addition to the first plane with cable strands of the further plane being a different sort from the the cable strands of the first plane, both planes being transported from the cable storer 1 at the outlet 3.

From the cable storer 1, the cable strands 4, 5 and 8 are guided into a cable feed changer 9 arranged at the outlet side of the cable storer 1. The cable feed changer 9 is fitted with guide elements known by persons skilled in the art, for example guide rolls (not represented) which are capable of individually conducting the cable strands in a preprogrammed feed into a single plane as shown in the drawings, this single plane being referred to as the drawn-off plane, so that the cable strands are at predetermined locations at the outlet 10 of the cable feed changer 9, which is indicated by the double arrow 11. Thus, the cable feed changer 9 can be programmed to feed all or a preselected number of the cable strands 4, all or a preselected number of the cable strands 5, and all or a preselected number of the cable strands 8 through the outlet 10, as shown for example below. Accordingly, only those guide rolls associated with the preselected cable strands 4, 5 and 8 will be activated in a known manner to feed or transport the preselected cable strands 4, 5 and 8.

Arranged after the cable feed changer 9 in transport direction of the cable strands, there is a cable entry device 12, which has arrangements (not represented) with which the cable strands running next to one another, are cut to length, severed and passed on to a transport device 13 which conveys the cut-to-length cable pieces (not represented) at a right angle to the drawing direction of the cable entry drive 12 individually stepwise, in which process the cable pieces are supported in their end regions.

A usable cable entry device is described, for example, in the above mentioned German unexamined patent specification No. OS 27 02 188. The specification and drawing of this unexamined patent specification hold also for the specification of the present invention insofar as they relate to the cable entry device including the transport, cutting to length, severing and gripping arrangement.

It also lies within the scope of the invention, however, to use other known similarly or like operating entry devices.

The transport device 13 supports the ends of the cable pieces cut to length equally or differently in length, in such a way that the cable pieces are positioned in the same horizontal plane, the two ends of each cable piece pointing in opposite directions. Accordingly, to the right and to the left, as shown in the drawing, beside the transport device 13, there are arranged devices that are to process the ends of the cable pieces.

In the case of the example represented it is a matter, preferably, of well known stripping devices 14, 15, 16 arranged on both sides, on outlet side of which there are arranged, preferably on both sides, well known crimping devices 17, 18, 19. Expediently, after the crimping devices there are arranged, preferably on both sides, well known testing devices 20, 21, 22. It is advantageous if there is arranged ahead of the insulation-stripping devices 14, preferably on both sides, a well known pressing device 23 and also a control arrangement 24 if one is used for the device of the invention for the activation of the selected ones of the guide rolls of the cable feed changer 9, where the components of such a control arrangement would be obvious to one skilled in the art.

The number of stripping and crimping devices, as well as the number of testing devices, is governed according to the number of cable types and cable strand planes. In the example shown, different cable types are used in three cable planes; accordingly, in each case there are installed on each side of the transport device 13 three stripping, crimping and testing devices, i.e., for each cable type there is arranged a stripping, crimping and testing device properly provided with corresponding tools or connectors attuned to the cable type. The programmable control arrangement 24 provides that there is a correct number of corresponding cut-to-length cable types which pass to the correct sequence device after leaving the entry device 12.

With the device of the invention, accordingly, like and/or different, for example three, cable types can be brought into an entry plane in front of the entry device 12. There the adjacently lying cable strands of the entry plane may constitute groupwise of different cable types. For example, from left to right as seen in transport direction of the drawn strands, there can lie two cable strands 4, upon which there follow laterally at an interval four cable strands 5 and four cable strands 8. This example makes it clear that obviously any arbitrary sequence is selectable for being fed out of the cable feed changer 9. It is likewise possible to omit cable strands or to leave gaps in the cable strand plane being drawn off from the cable feed changer 9, the selection of which is made in the control arrangement 24, which in turn controls which cable strands are to be fed through the cable feed changer 9.

The control device is coupled for this purpose with the cable feed changer and/or cable storer and/or the cable entry device in such a way that the preprogrammed cable strands are drawn and the cut-to-length cable pieces are brought before the correct succeeding device by the transport device 13. There, with the aid of a well known imprinting device the cut-to-length cable pieces are marked. The use of a cable feed changer 9 in conjunction with the guidance of the various cable types in different planes makes it possible, therefore very rapidly to cut to length different cable types without reoutfitting, to strip them and to fit them with connectors. The testing devices can thereupon ascertain whether the correct connector has been crimped onto the correct cable type.

What is claimed is:

1. A process for production of cables fitted with electrical connectors, comprising:

simultaneously drawing off a first set of several cable strands of one type and a second set of several cable strands of a different type from a cable storer;

conducting said first set from said cable storer in a first transport plane, and conducting said second set from said cable storer in a second transport plane parallel to said first transport plane;

feeding a preselected number of cable strands of said first set to a first predetermined location, and feeding a preselected number of cable strands of said second set to a second predetermined location;

gripping said preselected cable strands of said first and second sets when at said predetermined first and second locations, and conveying said preselected cable strands onward to be cut to selected lengths;

cutting said preselected cable strands to selected lengths to provide cable pieces;

stripping at least one end of each cable piece of its insulation; and fitting the stripped end of each cable piece with a connector so that there are a number of connector-fitted cable pieces of said one type and a number of connector-fitted cable pieces of said different type.

2. A process according to claim 1, including conducting said first set in said first transport plane in a position lying over said second set in said second transport plane.

3. A process according to claim 1, including simultaneously conveying several of said preselected cable strands onward for said cutting.

4. A process according to claim 1, wherein said cutting includes cutting several of said preselected cable strands into cable pieces of different lengths.

5. A process according to claim 1, including conveying said cable pieces onward en bloc from said cutting to said stripping.

6. A process according to claim 1, including alternately conveying said cable pieces of said one type to a first stripping device and said cable pieces of said different type to a second stripping device.

7. A process according to claim 6, including also alternately conveying said cable pieces of said one type to a first fitting device and said cable pieces of said different type to a second fitting device.

8. A process according to claim 7, including conveying said cable pieces after said cutting at a right angle to the feeding direction of said preselected cable strands of said first and second sets.

9. A process according to claim 1, including conveying said cable pieces after said cutting at a right angle to the feeding direction of said preselected cable strands of said first and second sets.

10. A process according to claim 1, including simultaneously drawing off a third set of several cable strands of still another type from the cable storer, conducting said third set from said cable storer in a third transport plane parallel to said first and second transport planes, feeding a preselected number of cable strands of said third set to a third predetermined location, gripping said preselected cable strands of said third set, and conveying said preselected cable strands of said third set onward to be cut into cable pieces of selected lengths to provide a number of connector-fitted cable pieces of said another type.

* * * * *